US010373601B2

(12) United States Patent
Lopez De Arroyabe et al.

(10) Patent No.: US 10,373,601 B2
(45) Date of Patent: Aug. 6, 2019

(54) SYSTEM AND METHOD FOR ACTIVE NOISE COMPENSATION IN MOTORCYCLES, AND MOTORCYCLE HAVING A SYSTEM FOR ACTIVE NOISE COMPENSATION

(71) Applicant: Bayerische Motoren Werke Aktiengesellschaft, Munich (DE)

(72) Inventors: Jose Lopez De Arroyabe, Munich (DE); Ralf Schmidt, Sauerlach (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/001,113

(22) Filed: Jun. 6, 2018

(65) Prior Publication Data

US 2018/0286377 A1 Oct. 4, 2018

Related U.S. Application Data

(63) Continuation of application No. PCT/EP2016/077532, filed on Nov. 14, 2016.

(30) Foreign Application Priority Data

Dec. 7, 2015 (DE) ..... 10 2015 224 382

(51) Int. Cl.
*G10K 11/178* (2006.01)

(52) U.S. Cl.
CPC ..... *G10K 11/17823* (2018.01); *G10K 11/178* (2013.01); *G10K 2210/128* (2013.01);
(Continued)

(58) Field of Classification Search
CPC .. G10K 11/178; H04R 3/005; H04R 2410/05; H04R 2410/07; H04R 2499/13
(Continued)

(56) References Cited

U.S. PATENT DOCUMENTS

2005/0117754 A1 6/2005 Sakawaki
2009/0205903 A1 8/2009 Evert et al.
(Continued)

FOREIGN PATENT DOCUMENTS

DE 10 2005 060 064 A1 6/2007
DE 102005060064 A1 * 6/2007 ..... G10K 11/178
(Continued)

OTHER PUBLICATIONS

International Search Report (PCT/ISA/210) issued in PCT Application No. PCT/EP2016/077532 dated Jan. 31, 2017 with English translation (six (6) pages).
(Continued)

*Primary Examiner* — Melur Ramakrishnaiah
(74) *Attorney, Agent, or Firm* — Crowell & Moring LLP

(57) ABSTRACT

A system and method for active noise compensation in a vehicle is provided. The system has at least one apparatus for detecting a noise, a computer unit for calculating a compensation sound, at least one apparatus for generating a compensation sound which interferes with the noise, and a device for detecting at least one driver-specific parameter. The compensation sound is calculated depending on the at least one driver-specific parameter. Also provided is a motorcycle having a system for active noise compensation.

20 Claims, 1 Drawing Sheet

(52) U.S. Cl.
CPC ..... *G10K 2210/1282* (2013.01); *G10K 2210/3011* (2013.01); *G10K 2210/3044* (2013.01)

(58) Field of Classification Search
USPC .... 381/71.4, 94.1, 71.1, 150, 190, 362, 370, 381/305
See application file for complete search history.

(56) References Cited

U.S. PATENT DOCUMENTS

| | | | | |
|---|---|---|---|---|
| 2014/0226831 | A1 | 8/2014 | Tzirkel-Hancock et al. | |
| 2014/0363009 | A1 * | 12/2014 | Trammell ..... | H04R 3/005 381/71.1 |

FOREIGN PATENT DOCUMENTS

| | | | | |
|---|---|---|---|---|
| DE | 10 2014 201 228 | A1 | 8/2014 | |
| EP | 1 538 601 | A2 | 6/2005 | |
| EP | 1538601 | A2 * | 6/2005 | ..... G10K 11/178 |
| EP | 1 727 131 | A2 | 11/2006 | |
| WO | WO 2013/049376 | A1 | 4/2013 | |

OTHER PUBLICATIONS

German-language Written Opinion (PCT/ISA/237) issued in PCT Application No. PCT/EP2016/077532 dated Jan. 31, 2017 (six (6) pages).
German-language Search Report issued in counterpart German Application No. 102015224382.6 dated Aug. 29, 2016 with partial English translation (twelve (12) pages).

* cited by examiner

SYSTEM AND METHOD FOR ACTIVE NOISE COMPENSATION IN MOTORCYCLES, AND MOTORCYCLE HAVING A SYSTEM FOR ACTIVE NOISE COMPENSATION

CROSS REFERENCE TO RELATED APPLICATIONS

This application is a continuation of PCT International Application No. PCT/EP2016/077532, filed Nov. 14, 2016, which claims priority under 35 U.S.C. § 119 from German Patent Application No. 10 2015 224 382.6, filed Dec. 7, 2015, the entire disclosures of which are herein expressly incorporated by reference.

BACKGROUND AND SUMMARY OF THE INVENTION

A system for active noise compensation is specified. The system for active noise compensation may be suitable, in particular, for use in the case of motorcycles. Furthermore, a motorcycle having such a system for active noise compensation and a method for active noise compensation are specified.

Systems for actively influencing noise or reducing noise, which are also referred to as ANC (active noise control) systems, serve to reduce the noise level of a disturbance source, for example in motor vehicles, by coupling in controlled acoustic signals. In this active compensation, the noise is reduced by the superposition of additional vibrations, so-called anti-noise.

By way of example, current ANC systems use the information from one or more microphones, which are preferably arranged in the vicinity of the driver of the motor vehicle. If the calculation of the anti-noise is only based on the information about the captured ambient noise, such a calculation must be effectuated very quickly so that the interfering anti-noise can be produced in good time.

Document DE 10 2005 060 064 A1 discloses a system for actively influencing noise, in which the engine speed and the vehicle speed of a vehicle are included in the calculation of the anti-noise.

A problem of at least some embodiments to be solved lies in specifying a system for active noise compensation in the case of motorcycles, by means of which an even more effective noise suppression is facilitated in comparison with the prior art. Further objects are to specify a motorcycle having such a system and a method for active noise compensation.

These objects are achieved by the subjects according to the independent patent claims. Advantageous embodiments and developments of the subject matter furthermore emerge from the dependent patent claims, the following description and the drawings.

A system described here for active noise compensation in the case of a motorcycle has, according to at least one embodiment, an apparatus for capturing a noise, a computer unit for calculating a compensation sound or anti-noise, and a device for producing the compensation sound which interferes with the noise. By way of example, the apparatus for capturing the noise may be embodied as a microphone or as a noise sensor. Furthermore, the apparatus for capturing the noise may comprise a plurality of microphones or noise sensors. By way of example, the apparatus for capturing the noise may be arranged on or in a motorbike helmet. The apparatus for producing the compensation sound may be, for example, an actuator which is embodied to emit a compensation sound. By way of example, the apparatus for producing the compensation sound may be embodied as a loudspeaker. Furthermore, the device for producing the compensation sound may have a plurality of actuators or loudspeakers. By way of example, the apparatus for producing the compensation sound may be likewise arranged on or in a motorbike helmet.

According to the invention, the system for active noise compensation furthermore has a device for capturing and/or entering at least one driver-specific parameter. The system for active noise compensation is preferably embodied in such a way that the compensation sound is calculated dependent on the at least one driver-specific parameter. In particular, the driver-specific parameter may be a characteristic value or a characteristic which depends on a driver of the motorcycle and which, for example, may be detected by the device or may be entered, for example manually.

According to a further embodiment, the device for capturing and/or entering the driver-specific parameter comprises a head position detection device for capturing a current position and/or spatial orientation of the head of a driver of the motorcycle. By way of example, the head position detection device may be embodied in such a way that it is able to detect the position or spatial orientation of the head of the driver of the motorcycle relative to the motorcycle or relative to a windshield of the motorcycle during a drive. By way of example, the head position detection device may have one or more sensors and/or one or more cameras, such as e.g. a depth camera.

According to a further embodiment, the device for capturing and/or entering the driver-specific parameter is embodied to capture and/or enter a body size of the driver of the motorcycle. By way of example, the body size can be entered manually by means of an input apparatus. Alternatively, the body size of the driver can be captured automatically by the device, for example by means of one or more sensors or one or more cameras.

According to a further embodiment, the device for capturing and/or entering the driver-specific parameter is embodied to capture and/or enter a helmet type, for example a motorbike helmet type, of the driver of the motorcycle. By way of example, the helmet type can be entered manually into the device by way of an input apparatus or it can be captured automatically by the device, for example by means of one or more sensors or one or more cameras.

According to a particularly preferred embodiment, the device for capturing and/or entering the driver-specific parameter is embodied in such a way that a plurality of driver-specific parameters, for example the parameters described above, can be captured or entered by means of the device and can be used for calculating the compensation sound.

According to a further embodiment, the system for active noise compensation has a device for capturing and/or entering at least one vehicle-specific parameter. The vehicle-specific parameter may be, in particular, a characteristic value or characteristic which depends on a vehicle, in particular a motorcycle, and which, for example, may be detected by the device or entered, for example manually. Preferably, the system for active noise compensation is embodied in such a way that the compensation sound is calculated dependent on the vehicle-specific parameter. By way of example, a vehicle-specific parameter may be the type of vehicle.

According to a further embodiment, the device for capturing and/or entering the vehicle-specific parameter is embodied to capture a current position or spatial orientation or alignment of a windshield of the motorcycle, in particular during a drive. By way of example, the device for capturing and/or entering the vehicle-specific parameter may have one or more sensors and/or one or more cameras.

According to a further embodiment, the device for capturing and/or entering the vehicle-specific parameter is embodied to capture and/or enter the vehicle type. By way of example, the vehicle type of the motorcycle can be entered manually into an input apparatus of the device or the vehicle type may be captured automatically by the device, for example by means of one or more sensors and/or one or more cameras.

According to a further embodiment, the device for capturing and/or entering the vehicle-specific parameter is embodied to capture a current inclination of the motorcycle. By way of example, the device may have one or more tilt sensors.

According to a further embodiment, the device for capturing and/or entering the vehicle-specific parameter is embodied to capture the speed of the motorcycle and/or to capture the engine speed of the motorcycle.

According to a particularly preferred embodiment, the device for capturing and/or entering the vehicle-specific parameter is embodied in such a way that a plurality of vehicle-specific parameters, for example the vehicle-specific parameters described above, may be captured or entered and used for calculating the compensation sound.

According to a further embodiment, the device for capturing and/or entering the driver-specific parameter and/or the device for capturing and/or entering the vehicle-specific parameter and/or the computer unit for calculating the compensation sound comprises a smartphone. By way of example, the smartphone may have an input apparatus for entering the driver-specific and/or vehicle-specific parameter. Furthermore, the smartphone may comprise a communication unit for communication with the motorcycle and/or for communication with one or more sensors or with one or more cameras.

Furthermore, a motorcycle which has a system, described herein, for active noise compensation is specified. The system for active noise compensation of the motorcycle may have one or more features of the aforementioned embodiments. Preferably, the motorcycle is embodied as a motorbike. Alternatively, the motorcycle may be embodied as a motor scooter or as a so-called light motorcycle, such as e.g. a moped or motor-assisted bicycle.

Furthermore, a method for active noise compensation in the case of a motorcycle is specified. In the method, a noise is captured by means of a noise capturing apparatus. By way of example, the noise capturing apparatus may be embodied as a microphone or as a noise sensor. Furthermore, at least one driver-specific parameter of a driver of a motorcycle is captured. Moreover, a compensation sound is calculated dependent on the at least one driver-specific parameter. By way of example, the driver-specific parameter may be a driver-specific parameter as described above in conjunction with the system for active noise compensation. Furthermore, a plurality of driver-specific parameters may be used to calculate the compensation sound. Moreover, a compensation sound, which interferes with the noise, is produced in the method. In particular, the compensation sound can be produced by an actuator or a loudspeaker.

According to a further embodiment, at least one vehicle-specific parameter is captured and used to calculate the compensation sound in the method for active noise compensation. In particular, the vehicle-specific parameter may be a vehicle-specific parameter which was described above in conjunction with the system for active noise compensation. Particularly preferably, a plurality of vehicle-specific parameters are used in the method to calculate the compensation sound.

According to a further embodiment, an above-described system for active noise compensation is used in the method for active noise compensation.

Using the system or method described here for active noise compensation, there may be a more effective anti-noise calculation or a more effective noise suppression when compared to the prior art, in particular by the inclusion of driver-specific and vehicle-specific parameters in the anti-noise calculation. No additional hardware is required if a smartphone is used as a device for capturing or entering the driver-specific and/or vehicle-specific parameter or if it is used as a computer unit. Furthermore, costs for the hardware can be reduced as less computational power is required for the anti-noise calculation.

Other objects, advantages and novel features of the present invention will become apparent from the following detailed description of one or more preferred embodiments when considered in conjunction with the accompanying drawings.

DETAILED DESCRIPTION OF THE DRAWINGS

In the example embodiments and figures, the same constituent parts or constituent parts with the same effect may be provided with the same reference signs. The presented elements and their size ratios in relation to one another should not, as a matter of principle, be considered to be true to scale.

Figure 1:
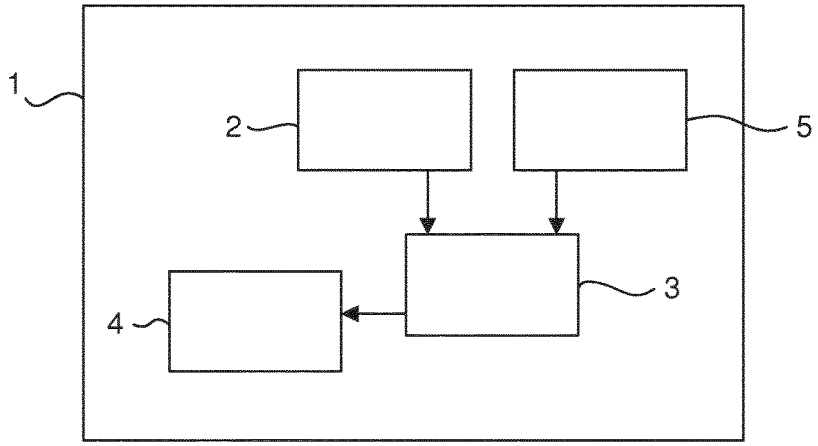
FIG. 1 shows a schematic illustration of a system for active noise compensation according to an embodiment of the present invention.

FIG. 1 shows a schematic illustration of a system 1 for active noise compensation in the case of a motorcycle, said system having an apparatus 2 for capturing a noise, a computer unit 3 for calculating a compensation sound and an apparatus 4 for producing a compensation sound. By way of example, the apparatus 2 for capturing the noise may be a microphone or a noise sensor. By way of example, the apparatus 4 for producing the compensation sound may be embodied as an actuator or a loudspeaker. Furthermore, the system 1 for active noise compensation has a device 5 for capturing and/or entering a driver-specific parameter or a plurality of driver-specific parameters. The driver-specific parameters may be, for example, a current head position of a driver of a motorcycle when driving, the body size of the driver of the motorcycle and/or a helmet type of the driver of the motorcycle.

Improved noise compensation can be obtained by including driver-specific parameters when calculating the compensation sound that interferes with the noise.

Figure 2:
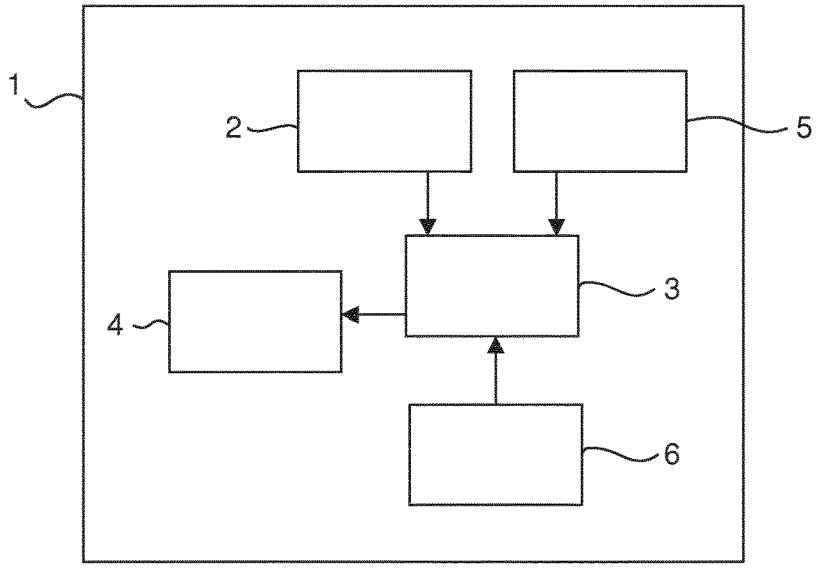
FIG. 2 shows a schematic illustration of a system for active noise compensation according to a further embodiment of the present invention.

FIG. 2 illustrates a further exemplary embodiment of a system 1 for active noise compensation. In contrast to the exemplary embodiment according to FIG. 1, the system 1 furthermore has a device 6 for capturing a vehicle-specific parameter or a plurality of vehicle-specific parameters. By way of example, the vehicle-specific parameters may be the position or spatial orientation of a windshield of a motorcycle, the vehicle type of a motorcycle, the current inclination of the motorcycle, the current speed of the motorcycle and/or the current engine speed of the motorcycle.

By including vehicle-specific parameters when calculating the compensation sound, it is possible to obtain a further improvement in the active noise compensation.

Alternatively, or additionally, the exemplary embodiments shown in the figures may have further features according to the embodiments of the general description.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE SIGNS

1 System for active noise compensation
2 Apparatus for capturing a noise
3 Computer unit for calculating a compensation sound
4 Apparatus for producing a compensation sound
5 Device for capturing a driver-specific parameter
6 Device for capturing a vehicle-specific parameter

What is claimed is:

1. An active noise compensation system for a motorcycle, comprising:
- a noise-capture unit configured to capture a noise near a driver of the motorcycle;
- a driver parameter input unit configured to obtain at least one driver-specific parameter;
- a computer unit configured to
  - receive a signal corresponding to a noise captured by the noise capture unit,
  - receive a signal corresponding to the at least one driver-specific parameter from the driver parameter input unit, and
  - calculate, based on the received noise signal and at least one driver-specific parameter signal, a compensation sound counter to the noise captured by the noise-capture unit; and
- a compensation sound production unit configured to generate the compensation sound calculated by the computer unit such that the compensation sound interferes with the noise near the driver of the vehicle.

2. The system as claimed in claim 1, wherein
- the driver parameter input unit includes a head position detection unit configured to capture a current position of the head of the driver.

3. The system as claimed in claim 1, wherein
- the driver parameter input unit is configured to at least one of capture and receive a body size of the driver.

4. The system as claimed in claim 1, wherein
- the driver parameter input unit is configured to obtain a helmet type of the driver.

5. The system as claimed in claim 1, further comprising:
- a vehicle parameter input unit configured to obtain at least one vehicle-specific parameter,
- wherein the computer unit is further configured to
  - receive a signal corresponding to the at least one vehicle-specific parameter from the vehicle parameter input unit, and
  - the calculation of the compensation sound is further based on the received at least one vehicle-specific parameter signal.

6. The system as claimed in claim 5, wherein
- the at least one vehicle-specific parameter is a position of a windshield of the motorcycle.

7. The system as claimed in claim 4, wherein
- the at least one vehicle-specific parameter is a motorcycle type of the motorcycle.

8. The system as claimed in claim 5, wherein
- the at least one vehicle-specific parameter is a motorcycle type of the motorcycle.

9. The system as claimed in claim 5, wherein
- the at least one vehicle-specific parameter is at least one of a vehicle speed and an engine speed of the motorcycle.

10. The system as claimed in claim 6, wherein
- the at least one vehicle-specific parameter is at least one of a vehicle speed and an engine speed of the motorcycle.

11. The system as claimed in claim 7, wherein
- the at least one vehicle-specific parameter is at least one of a vehicle speed and an engine speed of the motorcycle.

12. The system as claimed in claim 5, wherein
- the at least one vehicle-specific parameter is an inclination of the motorcycle.

13. A motorcycle, comprising:
- an active noise compensation system including
  - a noise-capture unit configured to capture a noise near a driver of a vehicle;
  - a driver parameter input unit configured to obtain at least one driver-specific parameter;
- a computer unit configured to
  - receive a signal corresponding to a noise captured by the noise capture unit,
  - receive a signal corresponding to the at least one driver-specific parameter from the driver parameter input unit, and
  - calculate, based on the received noise signal and at least one driver-specific parameter signal, a compensation sound counter to the noise captured by the noise-capture unit; and
- a compensation sound production unit configured to generate the compensation sound calculated by the computer unit such that the compensation sound interferes with the noise near the driver of the vehicle.

14. A method for active noise compensation on a motorcycle, including the acts of:
- capturing a noise near a driver of the motorcycle using a noise-capture unit;
- obtaining at least one driver-specific parameter of the using a driver parameter input unit;
- calculating using a computer unit, based on the noise captured by the noise capture unit and the at least one driver-specific parameter obtained by the driver parameter input unit, a compensation sound counter to the noise captured by the noise-capture unit; and
- producing the compensation sound which interferes with the noise calculated by the computer unit such that the compensation sound interferes with the noise near the driver of the vehicle.

15. The method as claimed in claim 14, wherein
- the driver parameter input unit includes a head position detection unit configured to capture a current position of the head of the driver.

16. The method as claimed in claim 14, further comprising the act of:
- obtaining at least one vehicle-specific parameter using a vehicle parameter input unit, wherein the act of calculating the compensation sound is further based on the at least one vehicle-specific parameter signal.

17. The method as claimed in claim 14, wherein the at least one vehicle-specific parameter is a position of a windshield of the motorcycle.

18. The method as claimed in claim 14, wherein the at least one vehicle-specific parameter is a motorcycle type of the motorcycle.

19. The method as claimed in claim 14, wherein the at least one vehicle-specific parameter is at least one of a vehicle speed and an engine speed of the motorcycle.

20. The method as claimed in claim 14, wherein the at least one vehicle-specific parameter is an inclination of the motorcycle.

* * * * *